US007497561B2

(12) United States Patent
Hashimoto

(10) Patent No.: US 7,497,561 B2
(45) Date of Patent: Mar. 3, 2009

(54) SEMICONDUCTOR DEVICE, INK CARTRIDGE, AND ELECTRONIC DEVICE

(75) Inventor: Nobuaki Hashimoto, Suwa (JP)

(73) Assignee: Seiko Epson Corporation (JP)

( * ) Notice: Subject to any disclaimer, the term of this patent is extended or adjusted under 35 U.S.C. 154(b) by 35 days.

(21) Appl. No.: 11/713,509

(22) Filed: Mar. 2, 2007

(65) Prior Publication Data

US 2007/0211088 A1 Sep. 13, 2007

(30) Foreign Application Priority Data

Mar. 13, 2006 (JP) ..... 2006-067425

(51) Int. Cl.
*B41J 2/09* (2006.01)

(52) U.S. Cl. ..... 347/77

(58) Field of Classification Search ..... 347/86, 347/85, 7, 19

See application file for complete search history.

(56) References Cited

FOREIGN PATENT DOCUMENTS

| | | |
|---|---|---|
| EP | 1164024 | 12/2001 |
| EP | 1382449 | 1/2004 |
| EP | 1602490 | 12/2005 |
| JP | 2002-257616 | 9/2002 |
| JP | 2002-283586 | 10/2002 |

*Primary Examiner*—K. Feggins
(74) *Attorney, Agent, or Firm*—Harness, Dickey & Pierce, P.L.C.

(57) ABSTRACT

A semiconductor device includes: a semiconductor substrate including an active element formation face on which an active element is formed, and a rear face that is on a side opposite to the active element formation face; detection electrodes formed on or above the active element formation face, detecting a remaining amount of ink by being wet in the ink; a penetration electrode penetrating a thickness direction of the semiconductor substrate; and a contact electrodes formed on or above the rear face, electrically connected to the detection electrodes via the penetration electrode, and transmitting and receiving information.

14 Claims, 8 Drawing Sheets

SEMICONDUCTOR DEVICE, INK CARTRIDGE, AND ELECTRONIC DEVICE

CROSS-REFERENCE TO RELATED APPLICATION

This application claims priority on Japanese Patent Application No. 2006-067425, filed Mar. 13, 2006, the contents of which are incorporated herein by reference.

BACKGROUND

1. Technical Field

The present invention relates to a semiconductor device, an ink cartridge, and an electronic device.

2. Related Art

There are conventional methods of managing ink consumption of ink cartridges in printers or the like that use ink for recording.

An example of such management methods is one which calculates ink consumption by using software to integrate the number of ink droplets ejected at the recording head and the amount of ink absorbed by maintenance.

However, this management method of using software to calculate ink consumption has problems such as the following.

There is weight variation in the ink droplets ejected in the head.

Although this weight variation of the ink droplets does not affect the image quality, it causes ink consumption amount errors which accumulate in the ink cartridge.

Consequently, the remaining amount of ink obtained by calculation and the actual remaining amount of ink differ, so that ink remains in the ink cartridge even though the remaining amount of ink is displayed as zero.

Users have noticed that exchanging a used ink cartridge with a new one even when ink remains results in a waste of the remaining ink.

In order to solve this problem, Japanese Unexamined Patent Application, First Publication No. 2002-283586 discloses a technique that uses a piezoelectric device to monitor the remaining amount of ink in an ink cartridge.

According to this method, the remaining amount of ink in the ink cartridge can be monitored using changes in the resonance frequency of a residual vibration signal generated by residual vibration of a vibration unit of the piezoelectric device.

However, in Japanese Unexamined Patent Application, First Publication No. 2002-283586, the sensor structure is complex and the accompanying system also becomes complex, increasing manufacturing costs.

Furthermore, when the ink cartridge is set inside a holder, an electrode terminal connected to the piezoelectric device contacts a contact terminal and becomes electrically connected to it.

However, in addition to the electrical connection between the electrode terminal of the piezoelectric device and the contact terminal in the holder, at least two or more electrical contact points are required between the ink cartridge and the main device, leading to concern over the reliability of the electrical connection.

Accordingly, the connections must be made secure to increase the reliability of the electrical contact points.

In the related art, systems wherein a detector for detecting ink information is independent from a storage unit for storing the ink information often store ink information detected via the main frame in the storage unit.

Consequently it is difficult to synthesize both types of information, and to perform simple and detailed information management such as ensuring that the ink cartridge cannot function unless it is set in the main device.

SUMMARY

An advantage of some aspects of the invention is to provide a semiconductor device, an ink cartridge, and an electronic device, in which it is possible to detect and manage information relating to ink in an ink cartridge accurately and reliably with a simple configuration, while stabilizing an electrical connection, preventing wasteful use of ink and increasing the satisfaction of the user.

A first aspect of the invention provides a semiconductor device including: a semiconductor substrate including an active element formation face on which an active element is formed, and a rear face that is on a side opposite to the active element formation face; detection electrodes formed on or above the active element formation face, and detecting a remaining amount of ink by being wet in the ink; a penetration electrode penetrating a thickness direction of the semiconductor substrate; and a contact electrodes formed on or above the rear face, electrically connected to the detection electrodes via the penetration electrode, and transmitting and receiving information.

According to this configuration, since the detection electrodes and the contact electrodes are separately formed on the surface (active element formation face) and the rear face of the semiconductor substrate, the surface space of the semiconductor substrate can be used efficiently and the semiconductor device can be miniaturized.

Moreover, since the penetration electrode penetrates the semiconductor substrate, excellent conductivity can be achieved between the active element formation face and the rear face without needing to extract an interconnection (conductive layer).

Since the interconnection is made to the shortest distance in comparison with conventional mount structures (e.g., wire bonding), surrounding noise is unlikely to infiltrate, and the reliability of the semiconductor device can be increased.

Since the semiconductor device combines the detection electrodes and the contact electrodes in a single unit, it is not troublesome to insert the ink cartridge, manufacture is easy, and the manufacturing cost can be reduced.

The number of electrical contact points from the detection electrodes to the contact electrodes can be reduced.

Using the detection electrodes wetted in the ink, it is possible to detect the remaining amount (actual amount) of ink in the container, and such lie, whereby it can be reliably ascertained whether ink is present in the ink cartridge.

Therefore, the ink cartridge can be replaced after using all of the ink, without leaving any in the container. The cost of the ink for the user can thereby be reduced. From the user's point of view, since ink is prevented from being wasted, his satisfaction is increased.

This important feature is common to all the effects described below.

It is preferable that the semiconductor device of the first aspect of the invention further include: a storage circuit formed on the semiconductor substrate, and storing a remaining amount of the ink; and a control circuit formed on the semiconductor substrate, and controlling the detection electrodes, the contact electrodes, and the storage circuit.

In this configuration, it is possible to store information detected by the detection electrodes to the storage circuit. Also, the controller can constantly update the ink information stored in the storage circuit. Thus, it is possible to reliably ascertain whether ink is present in the ink cartridge.

It is preferable that the semiconductor device of the first aspect of the invention further include: a first conductive layer formed on the active element formation face with a passivation film therebetween; a first protective film formed so as to cover the first conductive layer; and a first opening formed in the first protective film, exposing at least part of the first conductive layer. In this structure, the detection electrodes are constituted by the part of the first conductive layer exposed through the first opening.

It is preferable that the semiconductor device of the first aspect of the invention further include: a second conductive layer formed on the rear face with a passivation film therebetween; a second protective film formed so as to cover the second conductive layer; and a second opening formed in the second protective film, exposing at least part of the second conductive layer. In this structure, the contact electrodes are constituted by the part of the second conductive layer exposed through the second opening.

According to this configuration, parts of the conductive layers exposed through the openings function as the detection electrodes and the contact electrodes. Therefore, for example, the pitch between adjacent detection electrodes and contact electrodes can be increased by extracting the conductive layers to predetermined locations on the active element formation face or the rear face.

Since the areas of the detection electrodes and the contact electrodes are determined depending on the size of the openings, the detection electrodes and the contact electrodes can be formed to desired sizes (ranges).

It is preferable that the semiconductor device of the first aspect of the invention further include: a first conductive layer formed on the active element formation face with a passivation film therebetween; a first protective film formed so as to cover the first conductive layer; a first opening formed in the first protective film, exposing at least part of the first conductive layer; and a bump formed on the first conductive layer exposed through the first opening. In this structure, the detection electrodes are constituted by the bump.

According to this configuration, since the bump formed on the conductive layer constitutes the detection electrodes, the distance between the active element formation face and the rear face, that is, the distance between them in the thickness direction of the semiconductor substrate, can be increased, thereby preventing the active element formation face from being affected by ink.

It is preferable that the semiconductor device of the first aspect of the invention further include: a plated layer formed on a surface of the detection electrodes.

According to this configuration, the detection electrodes that contacts the ink is plated with, for example, a metal having excellent chemical resistance. Therefore, corrosion of the detection electrodes can be prevented, also infiltration of ink to the semiconductor substrate (active element formation face) can be prevented. For example, ink can be prevented from affecting the storage circuit and the controller (active elements).

Since most inks are generally strongly alkaline, infiltration of ink can be reliably prevented by using a chemical resistant metal as the plating material.

It is preferable that the semiconductor device of the first aspect of the invention further include: an insulating layer formed on or below a bottom layer of the detection electrodes.

According to this configuration, the distance from the active element formation face to the detection electrodes can be increased, preventing the active elements from being damaged by the ink.

It is preferable that the semiconductor device of the first aspect of the invention further include: a stress-relieving layer formed on or below a bottom layer of the detection electrodes.

According to this configuration, impact of the electrical contact point against the semiconductor substrate can be suppressed when, for example, electrically connecting the electronic device unit to the ink cartridge. A reliable electrical connection is thereby achieved, preserving the contact point lifespan and ensuring long-term reliability.

It is preferable that, in the semiconductor device of the first aspect of the invention, the detection electrodes be formed directly on the active element formation face, and the contact electrodes be formed directly on the rear face, using a same conductive material as that constituting the active element formed on the semiconductor substrate.

According to this configuration, the integrated circuit including the active element, the contact electrodes, and the detection electrodes can be formed simultaneously. This simplifies the manufacture.

It is preferable that the semiconductor device of the first aspect of the invention further include: three or more detection electrodes.

According to this configuration, even if the detection precision of, say, two of the detection electrodes deteriorates due to the presence of an air bubble or dirt between them, it is possible to compensate by the detection precision between the other detection electrodes, and accurate ink information indicating whether ink is present can be obtained.

A second aspect of the invention provides an ink cartridge used for an electronic device unit including an electrical contact point, the ink cartridge including: an ink cartridge casing including an container that accommodates ink; and a liquid sensor including a semiconductor device that detects and manages information relating to the ink accommodated in the container. In this structure, the semiconductor device includes: a semiconductor substrate including an active element formation face on which an active element is formed, and a rear face that is on a side opposite to the active element formation face; detection electrodes formed on or above the active element formation face and exposed in the container, and detecting a remaining amount of the ink by being wet therein; a penetration electrode penetrating a thickness direction of the semiconductor substrate; and a contact electrodes formed on or above the rear face, electrically connected to the detection electrodes via the penetration electrode, exposed toward the electrical contact point of the electronic device unit, and transmitting and receiving information to or from the electrical contact point.

According to this configuration, since the semiconductor device incorporates the detection electrodes and the contact electrodes in a single unit, ink information of the electronic device side (e.g., color, count number of ejected droplets, etc.) and ink information of the detection electrodes (e.g., remaining amount, actual amount, etc.) can be stored collectively in the storage circuit. Therefore, a broad range of information relating to the ink can be managed.

For example, ink information such as whether ink has been filled, the filling date, the ink depleted date, and the number of fillings can be stored beforehand in the storage circuit. As a result, it is possible to manage these pieces of information collectively with detailed information relating to the ink itself.

By managing detailed information in this way, it is possible to construct a system that supplies useful and detailed information to the user.

Even if the ink cartridge is not attached in the printer unit, it is possible to refer to the content information of the storage circuit, write to the storage circuit, and so on, in addition, ink information from the detection electrodes can be stored in the storage circuit without passing via the printer unit.

Therefore, it is possible to detect and manage the ink information in ink cartridge units, increasing the versatility of the ink cartridge.

Since it is possible to give management/detection functions to the ink cartridge, the number of interconnections on the electronic device unit side can be reduced and the structure can be simplified.

Therefore, the design layout of the electronic device unit can be made freer.

Since the detection electrodes of the semiconductor device is made to directly touch the ink by exposing it in the container of the ink cartridge casing, it is possible to detect the remaining amount of ink (whether ink is present) in the container.

By embedding elements other than the detection electrodes formed on the active element formation face in the ink cartridge, the ink can be prevented from damaging the active elements on the active element formation face.

Moreover, since the semiconductor device is arranged in the ink cartridge casing with the contact electrodes of the semiconductor device exposed on the electrical contact point side of the electronic device unit, excellent connection is achieved between the electrical contact point and the contact electrodes, increasing the transmission/reception efficiency of the information.

Therefore, it is possible to reliably know whether ink is present, and to replace the ink cartridge without leaving ink in the container.

It is preferable that, in the ink cartridge of the second aspect of the invention, a plurality of pairs of the detection electrodes of the semiconductor device be formed along the depth direction of the container, the detection electrodes being arranged along a bottom face of the container.

According to this configuration, as the amount of ink decreases, information (liquid level) indicating that there is no ink between the detection electrodes can be detected sequentially from between the detection electrodes thereabove. When information indicating that there is no ink is detected at the detection electrodes along the bottom face, information indicating that the ink has not completely emptied from the ink cartridge can be obtained. Thus, it is possible not only to obtain accurate information indicating whether ink is present, but also to obtain timely and precise information relating to the gradually decreasing amount of ink.

The user often becomes particularly concerned when the remaining amount of ink in the ink cartridge decreases to a small amount.

With this type of configuration, when the remaining amount of ink in the ink cartridge decreases to a level that concerns the user, the user can obtain timely information relating to the remaining amount of ink. Thus, the user's satisfaction can be greatly increased.

It is preferable that, in the ink cartridge of the second aspect of the invention, a plurality of the semiconductor devices be formed along the depth direction of the container, the detection electrodes of at least one of the semiconductor devices being arranged along a bottom face of the container.

According to this configuration, the liquid level of the ink can be detected and the remaining amount of ink can be accurately ascertained.

Furthermore, by arranging the detection electrodes of at least one of the semiconductor devices along the bottom face of the container, it is possible to accurately detect whether ink is present in the container.

Similarly in this configuration, when the remaining amount of ink in the ink cartridge decreases to a level that concerns the user, he can obtain timely information relating to the remaining amount of ink, greatly increasing his satisfaction.

A third aspect of the invention provides an electronic device including: an electronic device unit including an electrical contact point; and the above described ink cartridge that is electrically connected to the electronic device unit via the electrical contact point.

In this configuration, the ink cartridge and the electronic device unit are electrically connected by the electrical contact point, generating a stress at the electrical contact point and connecting them together reliably.

By arranging the configuration such that a stress is applied at the electrical contact point between the ink cartridge and the electronic device unit, thereby stabilizing the connection, the reliability of the connection is increased.

In comparison with transmission/reception of radio wave signals, it is possible to transmit and receive highly reliable information inexpensively and with a simple configuration.

Moreover, since ink information can be reliably detected and managed in the manner described above, it is possible to determine, for example, an appropriate replacement period of the ink cartridge.

Since the ink cartridge can be replaced without wasting ink, the replacement cycle of the ink cartridge can be extended and the ink-related cost can be reduced.

By managing detailed ink information in this way, the ink cartridge can be recycled efficiently and without waste.

Information such as the number of recycles of the ink cartridge can be determined from, for example, information relating to the number of ink filling, this information is useful not only in achieving functions that are essential in servicing the user, but also from an environmental perspective as regards recycling.

Obviously, a highly reliable, high-quality product can thereby be provided.

DESCRIPTION OF EXEMPLARY EMBODIMENTS

Embodiments of a semiconductor device, an ink cartridge, and an electronic device according to the invention will be explained with reference to FIGS. 1 to 8.

A semiconductor device 1 is contained in an ink cartridge 7 which is attached to a printer unit 23 (electronic device unit) including contact pin groups 21 (electrical contact point) described later.

Semiconductor Device

Figure 1:
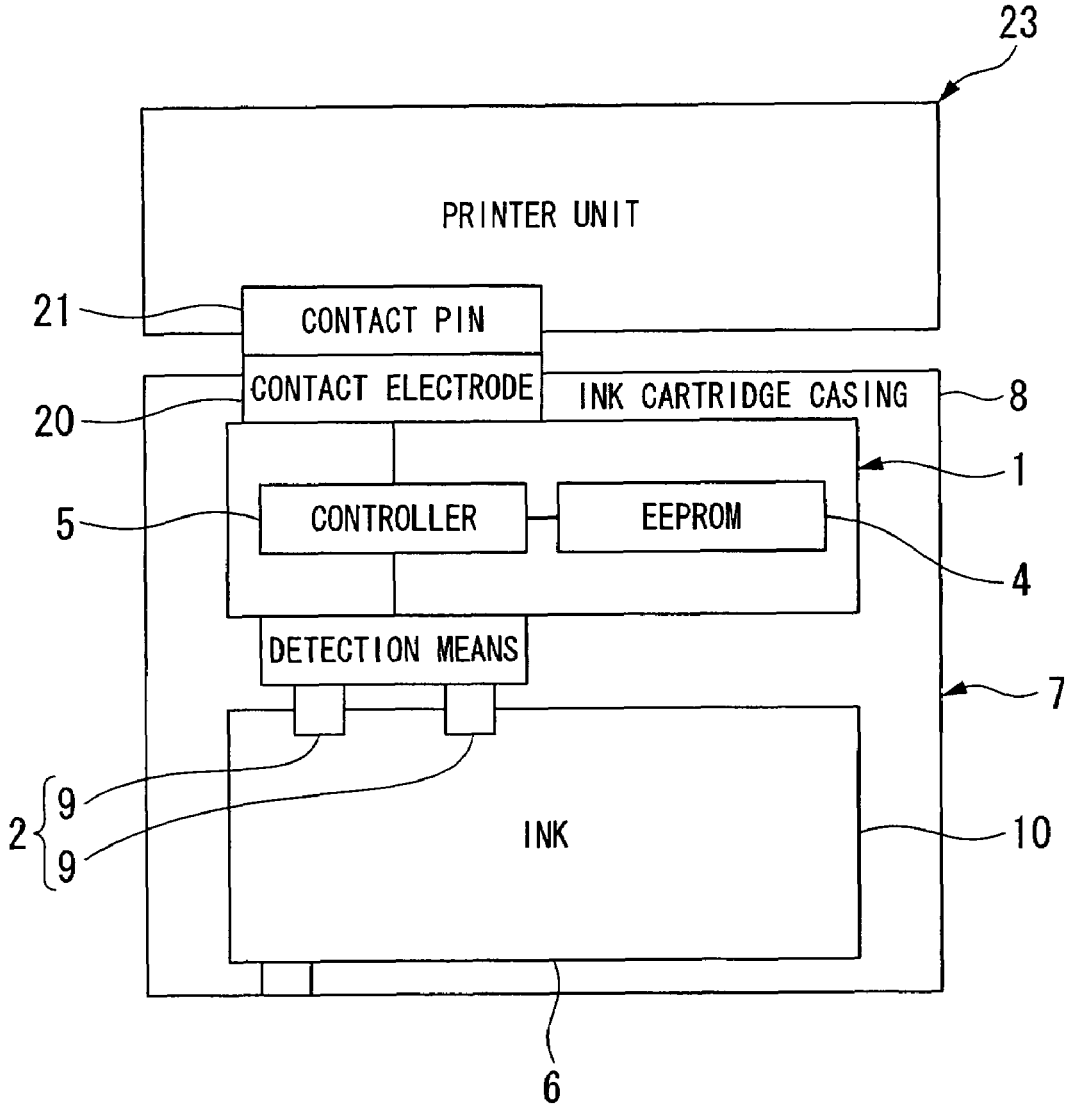
FIG. 1 is a schematic block diagram of an ink jet printer according to an example of the invention.

FIG. 1 is a block diagram of a basic configuration of an electronic device of the invention.

Figure 2:
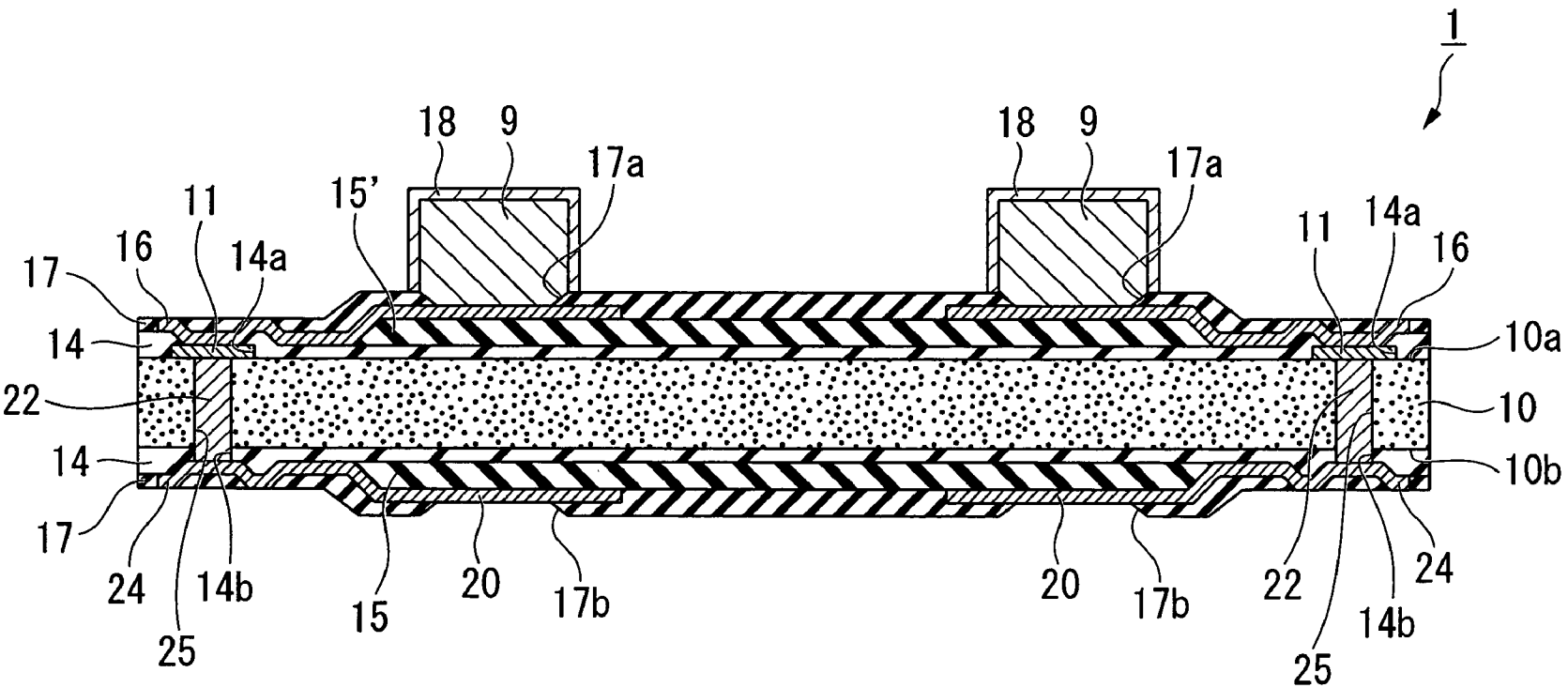
FIG. 2 is a cross-sectional view of a schematic diagram of a semiconductor device according to a first embodiment of the invention.

FIG. 2 is a cross-sectional view of a first embodiment of a semiconductor device of the invention.

Figure 3:
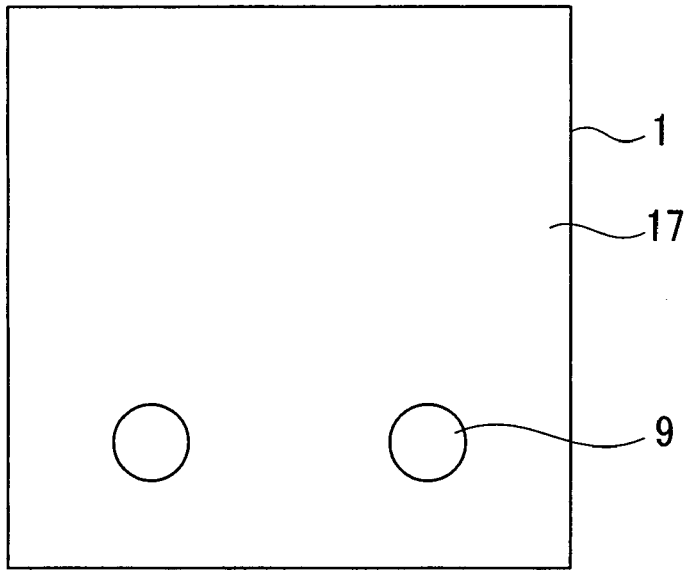
FIG. 3 is a plan view of the exterior of a semiconductor device according to a first embodiment of the invention.

FIG. 3 is an exterior view of a first embodiment of a semiconductor device of the invention.

In these diagrams, reference numeral 1 represents a semiconductor device having a wafer level chip scale package (W-CSP) structure.

The semiconductor device 1 includes liquid contact electrodes 9 (detection electrodes), a connection electrodes 20 (contact electrodes), an EEPROM 4 (storage circuit), and a controller 5 (control circuit), which are provided on a rectangular semiconductor substrate 10.

The liquid contact electrodes 9 detect a remaining amount of ink.

The connection electrodes 20 transmit and receive information to or from the contact pin groups 21 of the printer unit 23.

The EEPROM 4 stores ink information.

The controller 5 collectively controls the liquid contact electrodes 9, the connection electrodes 20, and the EEPROM 4.

The semiconductor substrate 10 is made from silicon.

An integrated circuit (not shown) includes the controller 5 and the EEPROM 4 constituted by active elements such as transistors, and is formed on an active element formation face 10*a* (surface) of the semiconductor substrate 10.

The integrated circuit includes at least an interconnection pattern, the EEPROM 4, the controller 5, and other active components being mutually connected by interconnections or the like.

In this embodiment, the EEPROM (nonvolatile memory) 4, which is a readable/writable recording medium, is used as the storage circuit.

The controller 5 performs updates or the like of ink information stored in the EEPROM 4 based on a remaining amount of ink in an ink tank 6 (container).

A pair of element electrodes 11 for making the integrated circuit conductive is provided in a peripheral portion of the active element formation face 10*a* of the semiconductor substrate 10.

Titanium (Ti), titanium nitride (Tin), aluminum (Al), copper (Cu), an alloy of these, or such like, can be used as material for the element electrodes 11.

In this embodiment, aluminum (Al) is used as the material for the element electrodes 11.

The element electrodes 11 formed on the active element formation face 10*a* are extracted to a rear face 10*b* of the semiconductor substrate 10 via a pair of through-holes 25 penetrating the semiconductor substrate 10.

The through-holes 25 penetrate the semiconductor substrate 10 from its active element formation face 10*a* to its rear face 10*b*.

The through-holes 25 are formed so as to have predetermined diameters using a conventional method such as, for example, photolithography.

During printing, a conductive paste is embedded in the through-holes 25, thereby so-called contact plugs that constitute penetration electrodes 22.

A material having low electrical resistance, such as copper (Cu) and tungsten (W), can appropriately be used as the conductive paste.

The penetration electrodes 22 protrude slightly from the rear face 10*b*.

As shown in FIG. 2, the through-holes 25 are formed directly below their respective element electrodes 11.

Active elements are not normally formed directly below the element electrodes 11.

Therefore, this configuration can minimize the area of the semiconductor substrate 10 without needing to allocate areas for forming the through-holes 25 on the active element formation face 10*a*.

In this method, it is possible to utilize element electrodes 11 that are essential to the semiconductor device 1.

Therefore, the semiconductor device 1 can be made versatile without requiring a customized design.

The element electrodes 11 formed on the active element formation face 10*a* are protected by a passivation film 14 that is formed on the active element formation face 10*a*.

The material used for the passivation film 14 is an electrical insulating material such as, for example, polyimide resin, silicone-modified polyimide resin, epoxy resin, silicone-modified epoxy resin, acrylic resin, phenol resin, benzocyclobutene (BCB), and polybenzoxazole (PBO).

It is also possible to use an inorganic material such as silicon oxide ($SiO_2$) and silicon nitride ($Si_3N_4$).

In this embodiment, polyimide resin is used as the material for the passivation film 14.

In the passivation film 14 formed on the active element formation face 10*a* of the semiconductor substrate 10, an insulating layer 15' made of insulating resin is formed in a center portion of the semiconductor substrate 10 at a position avoiding the element electrodes 11.

Also, a flexible stress-relieving layer 15 made of insulating resin is formed on the passivation film 14 formed on the rear face 10*b*, at a position avoiding the penetration electrodes 22.

As shown in FIG. 2, the stress-relieving layer 15 and the insulating layer 15' are formed in the center portion of the semiconductor substrate 10, and are substantially trapezoidal in cross-sectional view.

The materials for forming the stress-relieving layer 15 and the insulating layer 15' are selected as appropriate from among: photosensitive polyimide resin, silicone-modified polyimide resin, epoxy resin, silicone-modified epoxy resin, etc.

The formation of the insulating layer 15' on the active element formation face 10*a* alleviates thermal stress of the active element (integrated circuit), noticeably increasing its reliable life.

Openings 14*a* are formed in the passivation film 14 on or above the active element formation face 10*a* above the element electrodes 11.

With this configuration, the element electrodes 11 are exposed to the outside in the openings 14*a*.

Openings 14*b* are formed above the penetration electrodes 22 in the passivation film 14 on or above the rear face 10*b*, whereby the penetration electrodes 22 are exposed to the outside in the openings 14*b*.

A relocation interconnection 16 (first conductive layer) is electrically connected to the element electrodes 11 in the openings 14*a* of the passivation film 14.

The relocation interconnection 16 is for relocating the element electrodes 11 of the integrated circuit, and therefore extends from the element electrodes 11 arranged in a peripheral part of the semiconductor substrate 10 to the center sides of the semiconductor substrate 10 and also rising onto the insulating layer 15'.

This relocation interconnection 16 is generally so-called since it connects the element electrodes 11 of the semiconductor substrate 10 to the liquid contact electrodes 9 explained later.

The relocation interconnection is an important means of deviating the positions of the element electrodes 11 of the semiconductor substrate 10 that are often designed in minute detail and the physical positions of the rough-pitch liquid contact electrodes 9.

It is possible to detect whether ink is present by measuring the resistance and current between the liquid contact electrodes 9.

For example, if one liquid contact electrode 9 is connected to a transistor gate of a controller circuit and the other liquid contact electrode 9 is connected to the power source, a transistor that is ON when there is ink will switch OFF when there is no ink.

By detecting this switch, it is possible to determine whether ink is present.

In order to prevent deterioration in the ink composition due to electrolysis, the current flowing between the liquid contact electrodes 9 is made as small as possible, and is preferably pulsed.

A relocation interconnection 24 (second conductive layer) is electrically connected in the openings 14*b* in the passivation film 14 to the penetration electrodes 22 on the rear face 10*b* of the semiconductor substrate 10.

Since the relocation interconnection 24 is for relocating the penetration electrodes 22, the relocation interconnection 24 extends from the penetration electrodes toward the center portion, and rises onto the stress-relieving layer 15.

The relocation interconnection 24 connects the connection electrodes 20 described below.

While it is possible to use single-layer film, multi-layered film, or alloy film of gold (Au), copper (Cu), silver (Ag), titanium (Ti), tungsten (W), titanium tungsten (TiW), titanium nitride (TiN), nickel (Ni), nickel vanadium (NiV), chrome (Cr), aluminum (Al), palladium (Pd), and so on. As the material used for the relocation interconnections 16 and 24, in this embodiment they are formed from Cu.

A protective layer 17 (first protective film) is formed on or above the active element formation face 10*a* of the semiconductor substrate 10 so as to cover the relocation interconnection 16, the insulating layer 15', and the passivation film 14.

The protective layer 17 is made from a heat-resistant material of solder resist.

For example, an alkali-resistant resin such as polyimide resin, PPS, and PE is used in forming the protective layer 17.

Alternatively, SiN, $SiO_2$, SiON, or the like, can be used to form an inorganic film.

It is preferable that a material having a liquid repellency to the ink be used for the protective layer 17 in order to prevent a decrease in the resistance between the liquid contact electrodes 9 caused by ink remaining on the surface of the protective layer 17 (in order to enhance the S/N ratio of the wetted sensor) when the ink in the ink tank decreases to a small amount. In this embodiment, polyimide resin is used.

Openings 17*a* (first openings) are formed in the protective layer 17 over each of the relocation interconnections 16 of the insulating layer 15'.

With this configuration, the relocation interconnections 16 are partially exposed to the outside via the openings 17*a*.

The surface of the protective layer 17 can be treated with a process such as fluorination treatment and silicone treatment.

This broadens the range of resin materials that can be selected, even if the overall protective layer 17 does not have a liquid repellency to the ink.

The protective layer 17 can also cover the side faces of the semiconductor device 1.

This ensures that the semiconductor device 1 is not damaged by the ink.

Also, on the rear face 10*b*, a protective layer 17 (second protective film) made of solder resist, having a heat-resistance, is formed so as to cover the relocation interconnection 24, the stress-relieving layer 15, and the passivation film 14.

Opening 17*b* (second openings) are formed in this protective layer 17 over each of the relocation interconnections 24 of the stress-relieving layer 15.

This configuration exposes the relocation interconnection 24 to the outside in the openings 17*b*.

As shown in FIG. 2, a bump is formed above the relocation interconnection 16 exposed through each opening 17*a*, by growing an Au-plated film 18 (plated layer) on the surface of a core of Cu that can be plated at high-speed.

The bumps function as the liquid contact electrodes 9 for detecting ink information when wetted with ink.

By forming the Au plated film 18 on the Cu core surface, infiltration of ink to the semiconductor substrate 10 can be reliably prevented.

A metal which has excellent chemical resistance and is not affected by a strong alkaline ink component is preferably used as the plated film, instead of this Au-plated film, Pt-plated film, Ni-p plated film, Ni-p+Au plated film, and such like, can also be used.

Since the stress-relieving layer 15 is already formed below the liquid contact electrodes 9, the distance from them to the active element formation face 10*a* can be increased, further preventing the ink from affecting the active elements.

Parts of the relocation interconnection 24 exposed through the pair of openings 17*b* on or above the rear face 10*b* constitute the connection electrodes 20 that electrically connect to the printer unit 23.

An Au-plated film (not shown) is also grown over these connection electrodes 20, preventing them from oxidization when they are exposed to the outside.

Instead of Au-plated film, one of the plating materials mentioned above can be selected where appropriate.

Thus, the insulating layer 15', the relocation interconnection 16, and the protective layer 17 are formed on the active element formation face 10*a* of the semiconductor substrate 10, and the stress-relieving layer 15, the relocation interconnection 24, and the protective layer 17 are formed on the rear face 10*b* in the same arrangement.

Since it is possible to apply substantially the same manufacturing step to the top and bottom faces of the semiconductor substrate 10, the number of manufacturing steps is greatly reduced.

According to the above structure, since the liquid contact electrodes 9 and the connection electrodes 20 are separately arranged on the top and bottom faces of the semiconductor substrate 10, the surface space of the semiconductor substrate 10 can be utilized efficiently. It is possible to miniaturize the semiconductor device 1.

Also, use of the penetration electrodes 22 that penetrate through the thickness direction of the semiconductor substrate 10 eliminates the need to extract interconnections onto the face of the semiconductor substrate 10.

The active element formation face 10*a* and the rear face 10*b* can be made excellently conductive.

Since it is possible to arrange the interconnections at the shortest distance in comparison with conventional mounting structures (e.g., wiring bonding), surrounding noise cannot easily infiltrate, and the reliability of the semiconductor device 1 can be increased.

By configuring the semiconductor device 1 as a single unit combining the liquid contact electrodes 9, the connection electrodes 20, the controller 5, and the EEPROM 4, it is easily inserted to the ink cartridge 7, is easily manufactured, and its manufacturing cost can be reduced.

Since the liquid contact electrodes 9 can detect the remaining amount of ink (actual amount) in the ink tank 6 (container) or the like, it is possible to reliably ascertain whether there is ink in the ink cartridge 7.

As a result, it is possible to substitute the ink cartridge 7 without leaving any ink in the ink tank 6, and thereby reduces the cost of ink for the user.

With this configuration, an analog wetted signal from the liquid contact electrodes 9 can be output directly from the connection electrodes 20 as a digital signal via the controller 5.

Furthermore, the number of mechanical contact points can be reduced, and the information can be output on a stable digital signal instead of an unstable analog signal that is vulnerable to noise.

Since the liquid contact electrodes 9 are formed over the relocation interconnection 16 exposed via the openings 17*a* in the protective layer 17, and since parts of the relocation interconnection 24 exposed via the openings 17*b* in the protective layer 17 are the connection electrodes 20, it is possible, for example, to broaden the pitch between adjacent liquid contact electrodes 9 and between the connection electrodes 20.

Also, since the areas of the liquid contact electrodes 9 and the connection electrodes 20 depend on the sizes of the openings 17*a* and 17*b*, the liquid contact electrodes 9 and the connection electrodes 20 can be formed to desired sizes (ranges).

Instead of silicon, another material such as glass, quartz, and liquid crystal can be used in forming the semiconductor substrate 10.

While this embodiment depicts an example using the EEPROM 4 as the storage circuit, another storage element such as a Flush MEMORY can be used instead.

The relocation interconnections 16 and 24 can be formed by interconnections (Al, Cu) or the like that are used when forming the integrated circuit.

FIG. 3 is an example of the exterior of the semiconductor device 1 of the invention shown in cross-sectional view in FIG. 2.

In this example, detection electrodes include a pair of liquid contact electrodes 9, it being possible to detect whether ink is present by measuring the resistance and current between them.

Figure 4:
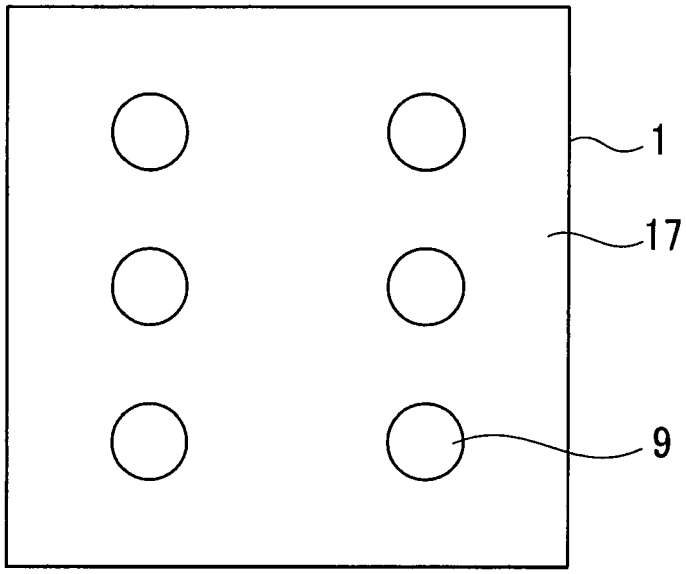
FIG. 4 is a plan view of the exterior of another embodiment of a semiconductor device.

FIG. 4 is another example of the exterior of the semiconductor device 1 of the invention shown in cross-sectional view in FIG. 2.

In this example, there are six liquid contact electrodes 9.

With this arrangement, even if the detection precision of one pair of liquid contact electrodes 9 decreases due to air bubbles or dirt between them, the detection precision can be supplemented between the other pairs of liquid contact electrodes 9. It is possible to obtain accurate information relating to whether ink is present.

In this case, reduction in precision can be prevented by using more than one pair of liquid contact electrodes 9, the detection precision increasing as the number of liquid contact electrodes 9 increases.

Three or more pairs of liquid contact electrodes 9 can be provided to obtain yet more detailed ink information.

Subsequently, a second embodiment will be described with reference to FIG. 5.

Figure 5:
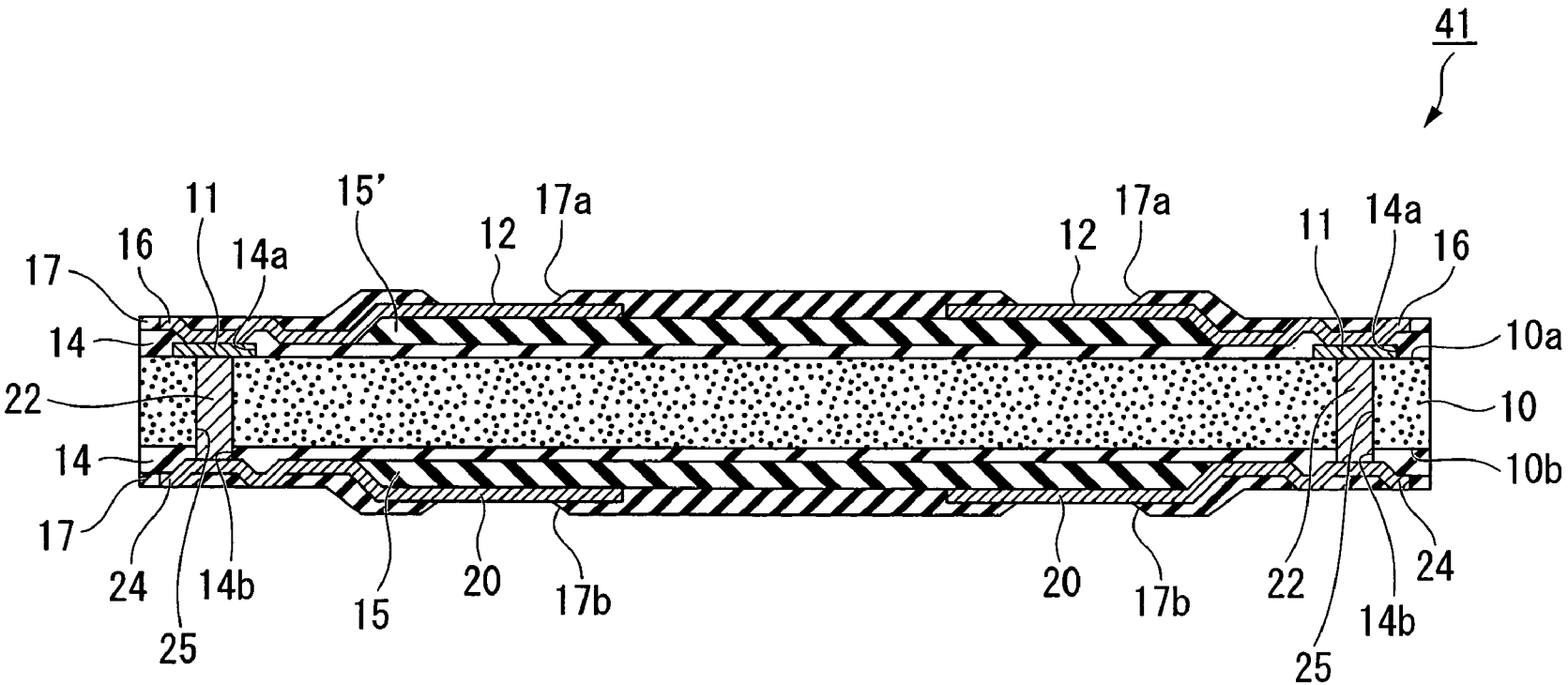
FIG. 5 is a cross-sectional view of a schematic diagram of a semiconductor device according to a second embodiment of the invention.

In FIG. 5, parts corresponding to those in FIGS. 1 to 3 are represented by like reference numerals, and are not repetitiously explained.

Reference numeral 41 represents a semiconductor device of the invention.

This embodiment differs from the first embodiment in that parts of the relocation interconnections 16 exposed via the openings 17*a* in the protective layer 17 over the active element formation face 10*a* are used as liquid contact electrodes 12 (detection electrodes).

In this embodiment, ink information is detected when the exposed parts of the relocation interconnections 16 are wetted by ink infiltrating into the openings 17*a*.

To achieve this, a plated layer of metal having excellent chemical resistance is formed over the relocation interconnections 16 exposed through the openings 17*a* in the same manner as described above.

In this embodiment, a Ni-p+Au plated film (not shown) is formed.

The plated film prevents ink from infiltrating into the semiconductor device 41 from the openings 17*a*.

In this structure, it is possible to prevent the ink from affecting the active elements (integrated circuit) on the active element formation face 10*a* of the semiconductor device 41.

By using parts of the relocation interconnections 16 as liquid contact electrodes 12 in this manner, similar effects to those of the first embodiment can be obtained with a simple configuration.

Ink Cartridge

Subsequently, an ink cartridge 7 of this embodiment will be explained with reference to FIGS. 1, 6, and 7.

Figure 6:
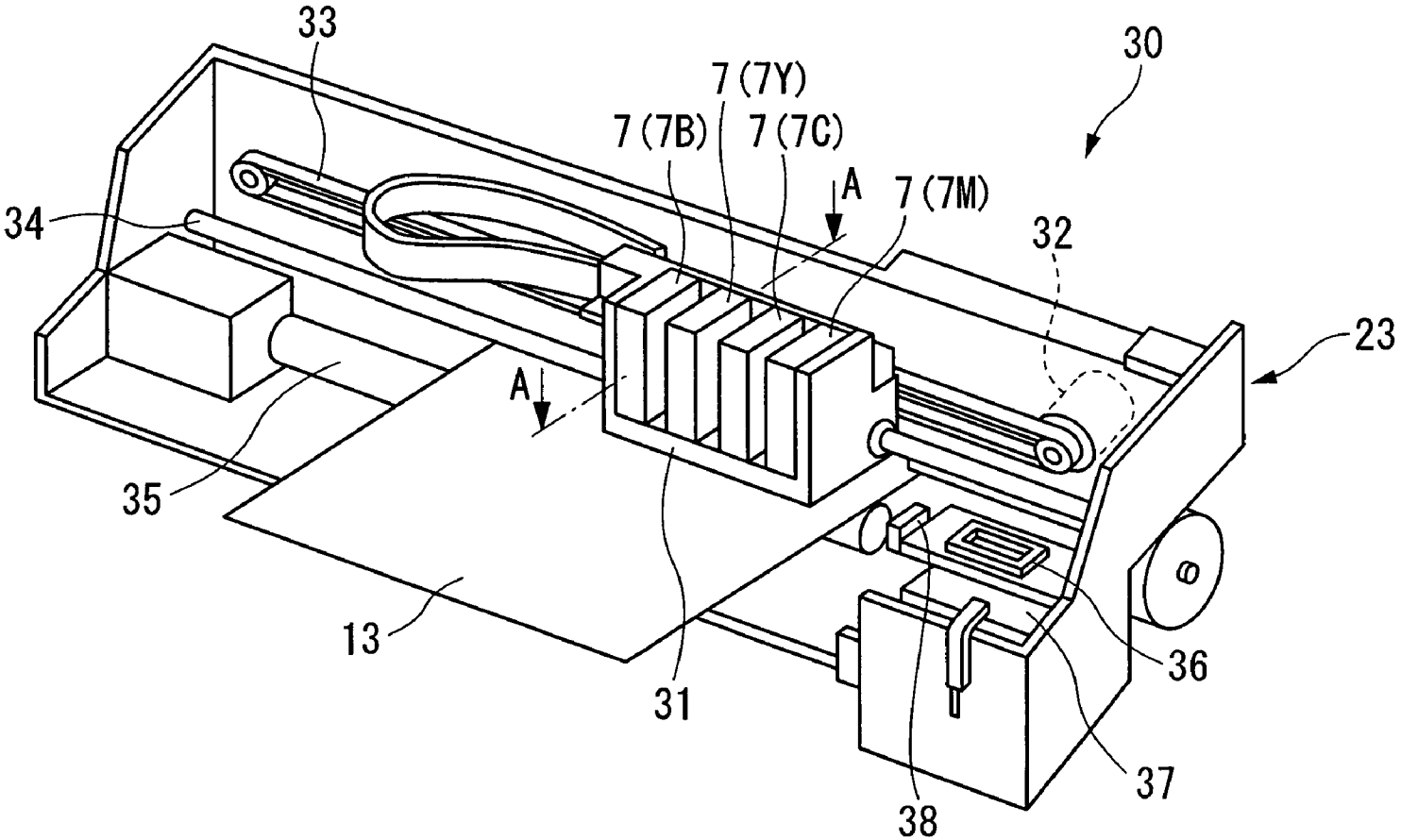
FIG. 6 is a perspective view of a primary configuration of an inkjet printer.
Figure 7:
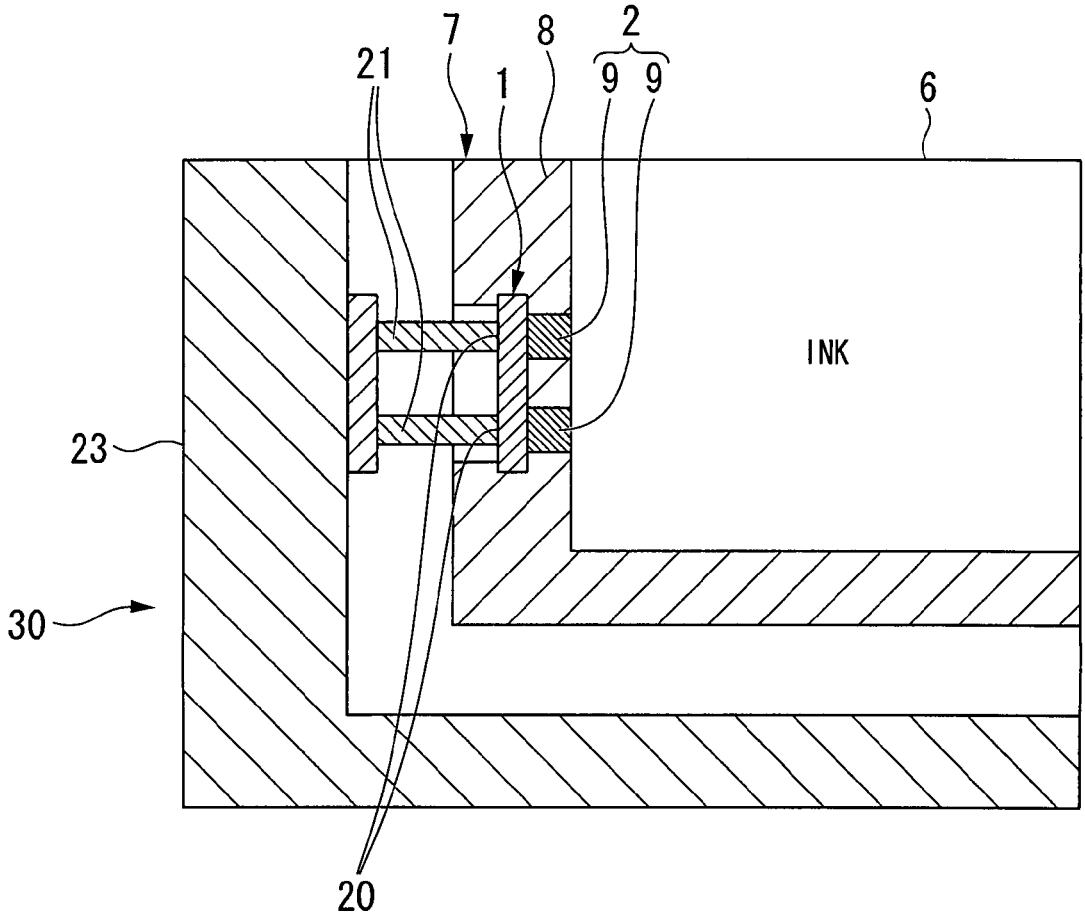
FIG. 7 is an explanatory cross-sectional view of an ink cartridge of the invention.

FIG. 7 is a cross-sectional view taken along A-A of FIG. 6.

The ink cartridge 7 contains the semiconductor device 1 described above, and is attached in a printer unit 23 (electronic device unit) including contact pin groups 21 (electrical contact points) described later.

The semiconductor device 1 includes a function of a liquid sensor for managing and detecting ink information in the ink cartridge 7.

As shown in FIG. 7, the ink cartridge 7 is formed in a single piece by, for example, resin injection molding, such that the semiconductor device 1 is accommodated in an ink cartridge casing 8 that includes an ink tank 6 for containing ink.

A pair of liquid contact electrodes 9 of the semiconductor device 1 is exposed in the ink tank 6 containing the ink, and a pair of connection electrodes 20 is exposed outside the ink cartridge 7.

Parts of the semiconductor device 1 other than the liquid contact electrodes 9 and the connection electrodes 20 are embedded in the ink cartridge casing 8. In this structure, the pair of liquid contact electrodes 9 is arranged below a wall section of the ink cartridge casing 8 such that the pair of liquid contact electrodes 9 disposes along the bottom face of the ink tank 6.

In this structure, it is possible to reliably detect whether ink is present.

Predetermined types of ink are contained in the ink tank 6 of each ink cartridge 7, the ink being fed out from a predetermined location in each ink cartridge 7.

In this configuration, since the ink cartridge 7 includes the semiconductor device 1 which is arranged in a single unit including the liquid contact electrodes 9, the controller 5, the EEPROM 4, and the connection electrodes 20, ink information in the printer unit 23 (e.g., color, count number of ejected droplets, etc.) and ink information in the liquid contact electrodes 9 (e.g., remaining amount, actual amount, etc.) can be collectively stored in the EEPROM 4, being possible to manage a broad range of information relating to the ink.

In addition, even if the ink cartridge 7 is not attached to the printer unit 23, it is possible to refer to the content information of the EEPROM 4, write to the EEPROM 4, and so on, moreover, ink information from the liquid contact electrodes 9 can be stored in the EEPROM 4 without passing via the printer unit 23.

It is preferable that ink information including, for example, the ink type (color), whether ink is filled, an ink filling date, an ink depleted date, number of ink fillings, and so on, be written to the EEPROM 4 before being shipped from the factory.

Therefore, it is possible to manage the ink information mentioned above collectively with detailed information relating to the ink.

It is also possible to detect and manage ink information in ink cartridge units, increasing the versatility of the ink cartridge 7.

Therefore, it is possible to substitute the ink cartridge 7 without leaving ink in the ink tank 6.

Since the liquid contact electrodes 9 of the semiconductor device 1 are arranged so as to expose in the ink tank 6 of the ink cartridge casing 8, they directly contact the in. It is possible to reliably detect the remaining amount of ink (whether ink is present) in the ink tank 6.

By embedding the semiconductor device 1 in this manner, it is possible to prevent from damaging of the active elements formed on the active element formation face 10*a* by contacting with the ink.

Since the space between the liquid contact electrodes 9 is covered with resin, it is possible to prevent incorrect determinations when the remaining amount of ink is small.

The ink cartridge 7 can contain a plurality of semiconductor devices 1.

In this case, the liquid contact electrodes 9 are arranged at predetermined intervals along the depth direction of the ink tank 6 in the wall of the ink cartridge casing 8.

In this structure, it is possible to detect the ink level, and to reliably ascertain the remaining amount of ink and the consumption course.

In this case, it is possible to reliably detect whether ink is present by arranging the liquid contact electrodes 9 of at least one semiconductor device 1 along a bottom face of the ink tank 6.

The semiconductor device 1 can be attached in the ink cartridge 7 after molding the ink cartridge 7.

The ink cartridge 7 can include a display unit for displaying the ink information stored in the EEPROM 4.

Figure 8:
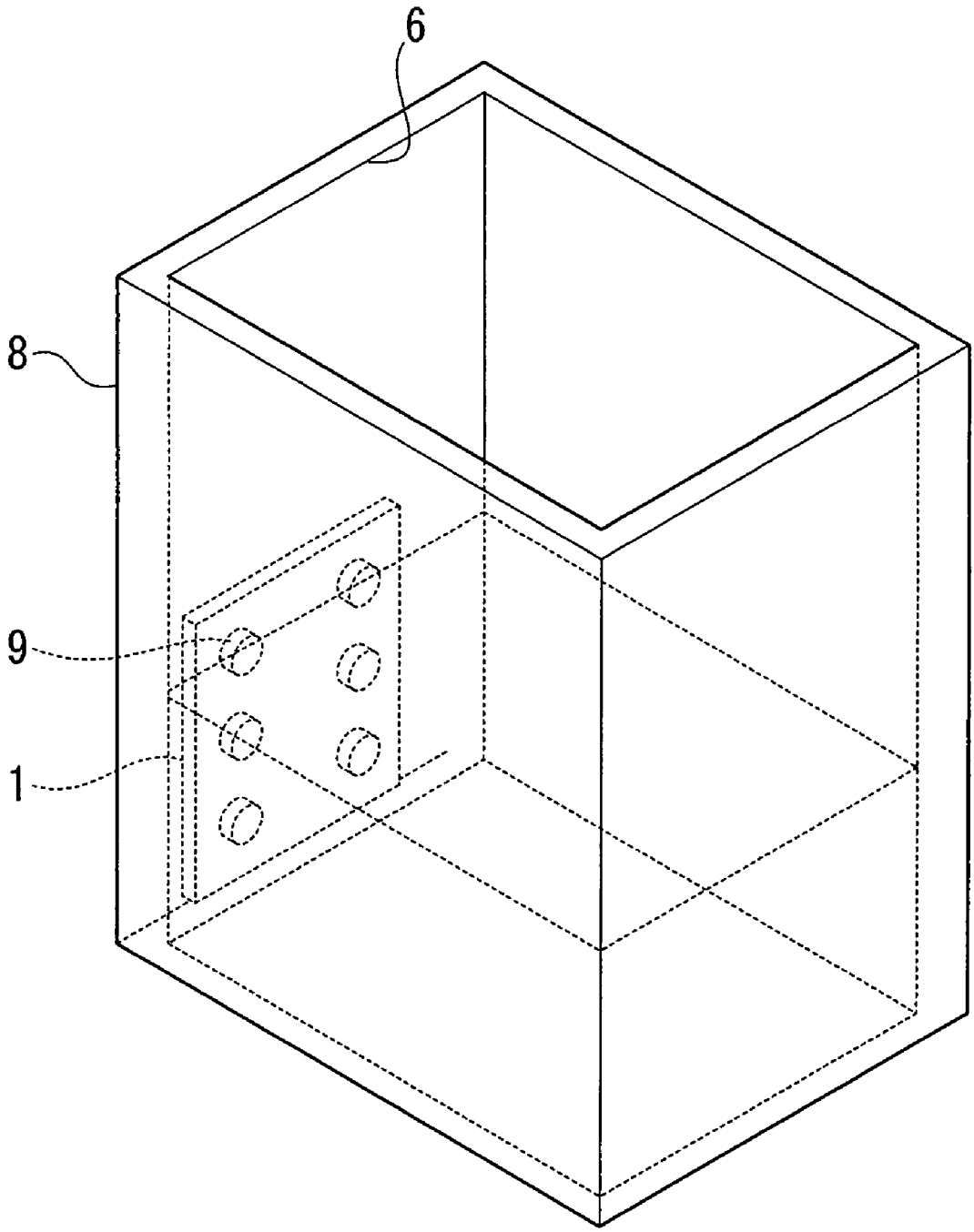
FIG. 8 is a plan view of a modification of an ink cartridge.

FIG. 8 is an embodiment of another ink cartridge 7 of the invention.

The semiconductor device 1 used here includes three pairs of liquid contact electrodes 9 as shown in FIG. 4.

The semiconductor device 1 is arranged along the depth direction of the ink tank 6 near the bottom of the inner wall of the ink cartridge casing 8.

Since there are three pairs of (i.e., six) liquid contact electrodes 9, the ink level can be detected by measuring which pair of liquid contact electrodes 9 is contacted with the ink, and the remaining amount of ink and the consumption course can be reliably ascertained.

At this time, if at least one pair of liquid contact electrodes 9 is arranged along the bottom face of the ink tank 6, it is possible to reliably detect whether ink is present.

By this means, it is possible to detect the abovementioned information by a single semiconductor device 1, achieving high-performance detection with a simple configuration.

Subsequently, a printer unit will be explained with reference to FIGS. 1, 6, and 7.

As shown in FIG. 6, a printer unit 23 includes a plurality of the ink cartridges 7, which can be inserted and removed.

The printer unit 23 includes contact pin groups 21, each of which connects with each of the connection electrodes 20 formed in the ink cartridge 7 shown in FIG. 7.

The printer unit 23 includes a recording head, and a paper handling mechanism.

Ink is supplied from each ink cartridge 7 to the recording head.

The paper handling mechanism delivers recording paper 13 relative to the recording head.

The printer unit 23 prints onto the recording paper 13 by ejecting ink onto it while moving the recording head in accordance with printing data.

As shown in FIG. 7, the contact pin groups 21 are positioned beforehand such that they can touch the connection electrodes 20 of the ink cartridge 7.

As shown in the ink cartridge 7 of FIG. 7, the connection electrodes 20 of the semiconductor device 1 are arranged in the ink cartridge casing 8 such that they are exposed so as to face the contact pin groups 21 of the printer unit 23.

By this means, an excellent connection between the contact pin groups 21 and the connection electrodes 20 are achieved.

It is preferable that elastic members such as springs (not shown) be used as the bases of the contact pin groups 21.

By this means, the contact pin groups 21 can move forwards and backwards in the direction of connection with the connection electrodes 20.

When the ink cartridge 7 is attached to the printer unit 23, the contact pin groups 21 are pressed by the connection electrodes 20 as they connect together.

Ink information is transmitted and received between the printer unit 23 and the ink cartridge 7 while the contact pin groups 21 and the connection electrodes 20 are electrically connected together in this state.

To stabilize the electrical connection, the contact pin groups 21 require a predetermined pressing force against the connection electrodes 20 on the ink cartridge 7.

This pressing force is greater than the reactive force received from the connection electrodes 20 required for mutual connection, and acts in a direction of which the contact pin groups 21 and the connection electrodes 20 are faced.

This is realized by the elastic members fitted to the contact pin groups 21.

The contact pin groups 21 use the elastic members to apply the force to the connection electrodes 20, stabilizing the connection.

Contact point stress between the contact pin groups 21 and the connection electrodes 20 are relieved by the stress-relieving layer 15 formed on or above the bottom layer of the connection electrodes 20.

Therefore, the contact pin groups 21 make excellent contact with the pair of connection electrodes 20, whereby the connection life and reliably can be increased.

Moreover, the ink cartridge 7 can be positioned with respect to the printer unit 23 using the pressing force of the contact pin groups 21.

The reactive force acting on the contact pin groups 21 is affected by, for example, the elastic force of the stress-relieving layer 15 which consists of a flexible resin material.

When the ink cartridge 7 and the printer unit 23 are connected by electrically connecting the contact pin groups 21 to the connection electrodes 20, and applying a stress to the relative electrical contact point, a stable connection and transmission/reception of information can be obtained between the ink cartridge 7 and the printer unit 23.

The connection between the connection electrodes 20 on the ink cartridge 7 and the contact pin groups 21 on the printer unit 23 can also be used in determining whether the ink cartridge 7 has been correctly attached to the printer unit 23.

At this time, for example, when the ink cartridge 7 is not correctly attached to the printer unit 23, a message indicating this is displayed on a display unit of the printer unit 23 or on a computer screen.

The printer unit 23 further includes a droplet ejection counter (not shown) that counts the number of ink droplets ejected from the ink cartridges 7, and calculates the remaining amount of ink in the ink tank 6.

As shown in FIG. 6, a plurality of ink cartridges 7 is attached in the printer unit 23 of this configuration.

The plurality of ink cartridges 7 are attached in parallel in an arrangement that is determined in advance according to the type of ink they contain.

When the ink cartridge 7 of this embodiment is attached in the printer unit 23, a required power is obtained from the contact pin groups 21 of the printer unit 23 connecting to the connection electrodes 20, and this power is used as driving power for the semiconductor device 1.

The semiconductor device 1 containing the semiconductor device 1 described above can be given managing and detecting functions.

By this means, it is possible to reduce the number of interconnections in the printer unit 23, and to simplify the structure.

Also, it is possible to realize more freedom of the design layout of the printer unit 23.

Ink information stored in the EEPROM 4 of the ink cartridge 7 is preserved even when the power of the printer unit 23 is switched off and when the ink cartridge 7 is removed from the printer unit 23.

By this means, it is possible to detect and manage the ink information in ink cartridge units.

Electronic Device

Subsequently, a primary configuration of an inkjet printer 30 (electronic device) according to the invention will be explained based on the embodiment shown in FIGS. 1 and 6.

The inkjet printer 30 includes a plurality of ink cartridges 7 that can be attached and removed to or from the printer unit 23.

In FIG. 6, reference numeral 31 represents a carriage. This carriage is guided by a guide rod 34 while moving back and forth along the axial direction of a platen 35 by means of a timing belt driven by a carriage motor 32.

The recording paper 13 is arranged in a scanning region scanned by the carriage 31, and is carried at a right angle to the scanning direction of the carriage 31.

A recording head is provided on a face of the carriage 31 that is opposite the recording paper 13.

Ink cartridges 7B, 7Y, 7C, and 7M that supply inks in colors of black, yellow, cyanogen, and magenta to the recording head are removably attached to its top.

A capping mechanism 36 is provided at a home position that is outside a non-printing region.

When the carriage 31 moves to the home position, in conjunction with the movement of the carriage 31, the capping mechanism 36 seals a nozzle formation face of the recording head that is mounted on the carriage 31.

The capping mechanism 36 falls in conjunction with the movement of the carriage 31 toward the printing region, whereby the sealed state of the recording head can be cancelled.

A suction pump 37 is arranged below the capping mechanism 36, and applies negative pressure to an internal space of the capping mechanism 36.

The capping mechanism 36 functions as a lid for preventing drying of the nozzle opening of the recording head while the inkjet printer 30 is not in use.

The capping mechanism 36 also functions as an ink receiver when a flushing operation is performed in order to eject ink droplets by applying a drive signal unrelated to printing to the recording head.

Moreover, the capping mechanism 36 also functions as a cleaning mechanism that performs suction emission of ink from the recording head by applying the negative pressure from the suction pump 37 to the recording head.

A wiping member 38 made from an elastic plate of rubber or the like is arranged adjacent to a region of the capping mechanism 36 which is closer to the printing region.

When necessary, the wiping member 38 performs a cleaning operation by wiping the nozzle formation face of the recording head as the carriage 31 moves back and forth to the capping mechanism 36.

The inkjet printer 30 moves the recording paper 13 relative to the inkjet recording head which receives the supply of ink from the ink cartridges 7.

Recording is performed by ejecting ink droplets onto the recording paper 13 while moving the recording head in accordance with the printing data.

Figure 9:
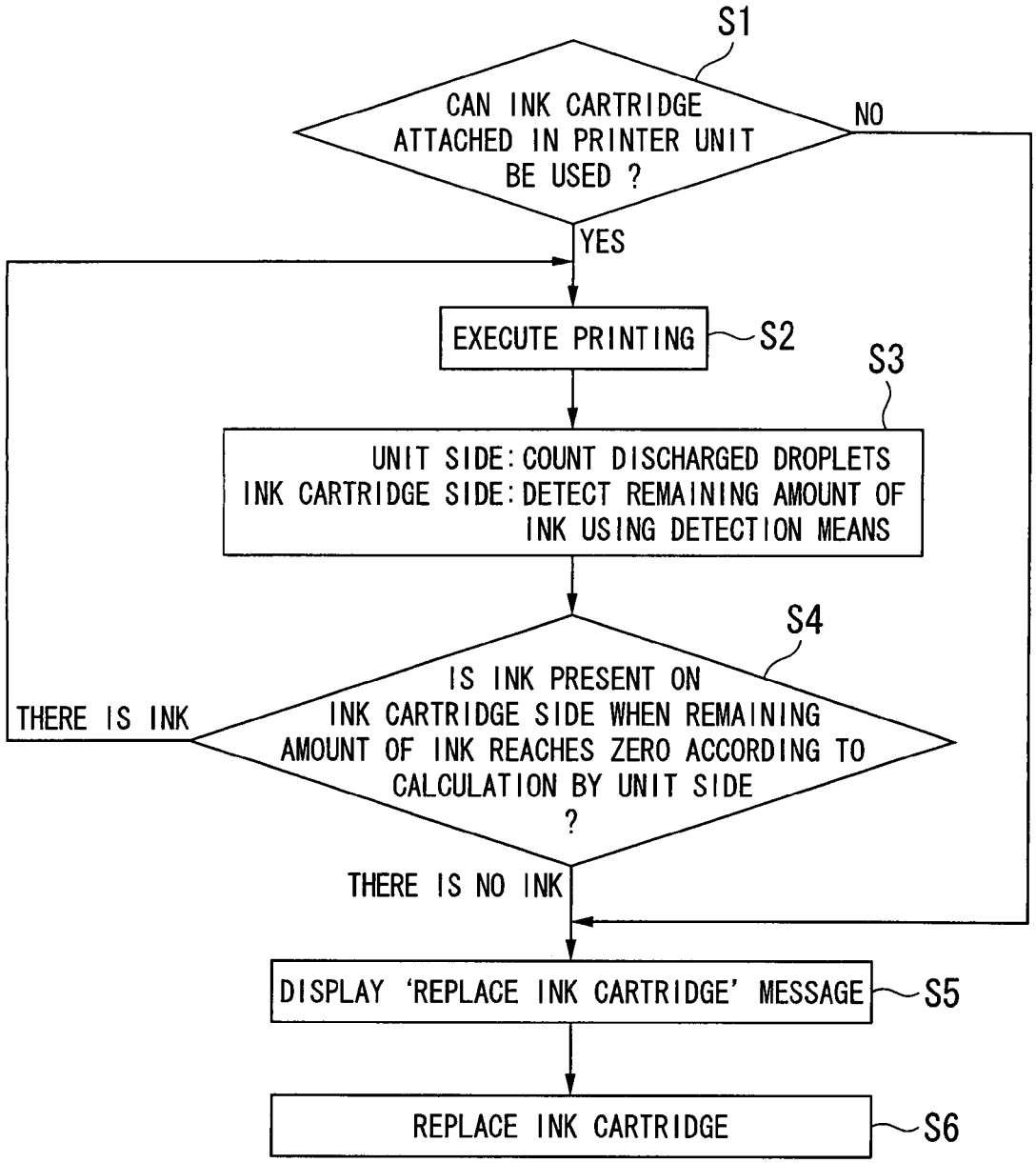
FIG. 9 is a flowchart of an ink jet printer system.

Subsequently, a system of the inkjet printer 30 will be explained with reference to FIG. 9.

Firstly, the ink cartridge 7 is attached to the printer unit 23.

In step S1, whether the ink cartridge 7 attached to the printer unit 23 can be used is detected. At this time, signals are transmitted and received between the contact pin groups 21 and the connection electrodes 20.

Power is then supplied to the connection electrodes 20 from the printer unit 23 by transmitting a signal from the contact pin groups 21, thereby activating the IC of the semiconductor device 1 and applying a predetermined voltage to the liquid contact electrodes 9.

When the ink tank 6 contains ink, current flows between the liquid contact electrodes 9 while passing through the ink touching them.

A signal (current value) detected by the liquid contact electrodes 9 is output to the controller 5.

When the detected signal indicates conductivity between the liquid contact electrodes 9, the controller 5 determines that there is ink and supplies ink information (indicating whether ink is present) based on this determination to the EEPROM 4.

When that the ink cartridge 7 can be used is determined, this information is sent to the printer unit 23. The printer unit 23 enters a print standby state, and, when the printer unit 23 receives a print signal, recording of the printing data is executed as shown in step S2.

On the other hand, when the detected signal indicates no conductivity between the liquid contact electrodes 9, the controller 5 determines that there is no ink ('ink depleted' state).

Ink information (indicating whether ink is present) based on that determination is stored in the EEPROM 4, and the procedure shifts to step S5, in which a signal requesting replacement of the ink cartridge 7 is output to the printer unit 23.

By detecting the conductive state between the liquid contact electrodes 9 in this way, whether ink is present in the ink tank 6 is confirmed, and the usability of the ink cartridge 7 can be determined.

As shown in step S2, when the printer unit 23 is being driven so as to execute printing, as shown in step S3, the ink cartridge 7 detects the conductive state between the liquid contact electrodes 9 at predetermined times.

The detection signal (current value) detected by the liquid contact electrodes 9 is output to the controller 5.

The detection cycle of the ink information is adjusted as appropriate.

The controller 5 constantly updates the ink information of the EEPROM 4 based on the determination result.

In this manner, the remaining amount of ink (whether ink is present) is monitored.

The controller 5 outputs the ink information stored in the EEPROM 4 via the connection electrodes 20 to the printer unit 23, where the ink information is supplied to the user from a display unit or from a computer screen.

As shown in step S3, software on the printer unit 23 calculates the amount of remaining ink from the sum of a count number of ejected ink droplets and the amount of ink used in maintenance.

The result is sent to the EEPROM 4 of the ink cartridge 7 via the connection electrodes 20 at each predetermined time, and the EEPROM 4 manages the remaining amount of ink (consumption amount).

In this way, ink-related information of the insulating layer 44 is constantly updated based on a signal output from the contact pin groups 21 of the printer unit 23.

Information stored in the EEPROM 4 is then supplied from the EEPROM 4 via the connection electrodes 20 to the user by being displayed a computer screen or a display unit on the printer unit 23.

In this manner, the user can monitor the progress of ink consumption, confirm the remaining amount of ink, etc.

Shortly after printing starts, for example, a calculation result indicating that the remaining amount of ink has reached zero is transmitted from the printer unit 23 to the controller 5.

However, as shown in step S4, when the detection signal between the liquid contact electrodes 9 indicates that ink is present (i.e., when the status between the liquid contact electrodes 9 is conductive), that ink remains in the ink tank 6 is clear, and therefore, that there is no ink in the ink tank 6 is not determined at this point; the procedure returns to step S2 and recording of the printing data is continued.

Thereafter as shown in step S4, when a signal indicating that the liquid contact electrodes 9 have ceased to be conductive is detected on the ink cartridge 7, the controller 5 determines, based on that signal, that a state of 'ink depleted' has been reached, and updates the ink information in the EEPROM 4.

Since the pair of liquid contact electrodes 9 are provided along the bottom face of the ink tank 6, the fact that they cease being conductive indicates that there is no ink in the ink tank 6.

Since this is more reliable than the calculation of remaining amount of ink made by the droplet ejection counter, the controller 5 always gives priority to the signal from the liquid contact electrodes 9 that actually contact the ink.

A discrepancy between the remaining amount of ink amount from the droplet ejection counter and the actual amount of ink remaining in the ink tank 6 often occurs due to variation in the weight of the ink droplets and variation in the amount of ink injected at the time of manufacture.

Priority is given to the signal from the liquid contact electrodes 9 in order to prevent a command being made to replace the ink cartridge 7 even when there is ink remaining in the ink tank 6 after the controller 5 determines that the ink cartridge 7 has reached a state of 'ink depleted' at the point where the remaining amount of ink according to the droplet ejection counter reaches zero.

After determining that the ink is depleted based on the signal from the liquid contact electrodes 9, in step S5, the controller 5 outputs a signal requesting replacement of the ink cartridge 7 to the printer unit 23, and a warning is issued to the user from a display unit (not shown) of the printer unit 23 or a computer screen.

In this manner, the user to know when to replace the ink cartridge 7.

As shown in step S6, an ink cartridge 7 that has reached the ink depleted state is removed from the printer unit 23 and replaced with a new ink cartridge 7.

For example, if the remaining amount of ink calculated by the droplet ejection counter on the printer unit 23 indicates that ink remains even though the liquid contact electrodes 9 of the ink cartridge 7 clearly indicate that the ink in the ink tank 6 has reached the ink depleted state, this is regarded as an error on the printer unit 23, and an error message is displayed on a display unit of the printer unit 23 or on a computer.

Furthermore, when the printer unit 23 calculates that the remaining amount of ink is zero, if the amount of ink remaining in the ink cartridge 7 at that point is determined to be much greater than the remaining amount of ink caused by variation in the weight of the ink droplets, that the ink droplets being ejected are of a smaller amount than usual is assumed.

In this case, a message suggesting that, for example, the ink ejection head should be cleaned, is displayed on a display unit or a computer screen.

Thus, the EEPROM 4 jointly manages ink information on the printer unit 23 and ink information that is detected using the liquid contact electrodes 9 of the ink cartridge 7, and detects errors in the printer unit 23 and the ink cartridge 7 by comparing the two types of information.

According to the inkjet printer 30 of this embodiment, since the ink cartridge 7 and the printer unit 23 are connected by the contact pin groups 21, an excellent electrical connection is achieved. It is possible to electrically connect them together reliably.

By applying a stress that stabilizes the electrical contact points between the ink cartridge 7 and the printer unit 23, the reliability of the connection can be increased.

In comparison with transmission/reception of radio wave signals, it is possible to transmit and receive highly reliable information inexpensively and with a simple configuration.

Moreover, since ink information can be reliably detected and managed with a simple configuration, it is possible to determine, for example, an appropriate replacement period of the ink cartridge 7.

Since the ink cartridge 7 can be substituted without wasting ink, the replacement cycle of the ink cartridge 7 can be extended, reducing the cost for the user.

By managing the ink information in detail in this manner, the ink cartridge 7 can be recycled efficiently and without waste.

Furthermore for example, information such as the number of recycles of the ink cartridge 7 can be determined from information relating to the number of ink fillings, this information is useful not only to the user but also to the recycler (manufacturer).

It is therefore possible to provide a highly reliably, high-quality product that enables detection and management of information relating to ink in the ink cartridge 7 to be performed accurately and reliably with a simple configuration.

While preferred embodiments of the invention have been described and illustrated above, these are exemplary of the invention and are not to be considered as limiting. Additions, omissions, substitutions, and other modifications can be made without departing from the spirit or scope of the present invention. Accordingly, the invention is not to be considered as being limited by the foregoing description, and is only limited by the scope of the appended claims.

What is claimed is:

1. A semiconductor device comprising:

a semiconductor substrate including an active element formation face on which an active element is formed, and a rear face that is on a side opposite to the active element formation face;

detection electrodes formed on or above the active element formation face, and detecting a remaining amount of ink by being wet in the ink;

a penetration electrode penetrating in a thickness direction of the semiconductor substrate from the active element formation face to the rear face; and contact electrodes formed on or above the rear face, electrically connected to the detection electrodes via the penetration electrode, and transmitting and receiving information.

2. The semiconductor device according to claim 1, further comprising:

a storage circuit formed on the semiconductor substrate, and storing a remaining amount of the ink; and a control circuit formed on the semiconductor substrate, and controlling the detection electrodes, the contact electrodes, and the storage circuit.

3. The semiconductor device according to claim 1, further comprising:

a first conductive layer formed on the active element formation face with a passivation film therebetween;

a first protective film formed so as to cover the first conductive layer; and a first opening formed in the first protective film, exposing at least part of the first conductive layer, wherein the detection electrodes are constituted by the part of the first conductive layer exposed through the first opening.

4. The semiconductor device according to claim 1, further comprising:

a second conductive layer formed on the rear face with a passivation film therebetween;

a second protective film formed so as to cover the second conductive layer; and a second opening formed in the second protective film, exposing at least part of the second conductive layer, wherein the contact electrodes are constituted by the part of the second conductive layer exposed through the second opening.

5. The semiconductor device according to claim 1, further comprising:

a first conductive layer formed on the active element formation face with a passivation film therebetween;

a first protective film formed so as to cover the first conductive layer;

a first opening formed in the first protective film, exposing at least part of the first conductive layer; and a bump formed on the first conductive layer exposed through the first opening, wherein the detection electrodes are constituted by the bump.

6. The semiconductor device according to claim 1, further comprising:

a plated layer formed on a surface of the detection electrodes.

7. The semiconductor device according to claim 1, further comprising:

an insulating layer formed on or below a bottom layer of the detection electrodes.

8. The semiconductor device according to claim 1, further comprising:

a stress-relieving layer formed on or below a bottom layer of the detection electrodes.

9. The semiconductor device according to claim 1, wherein the detection electrodes are formed directly on the active element formation face, and the contact electrodes is formed directly on the rear face, using a same conductive material as that constituting the active element formed on the semiconductor substrate.

10. The semiconductor device according to claim 1, further comprising:

three or more detection electrodes.

11. An ink cartridge used for an electronic device unit including an electrical contact point, the ink cartridge comprising:

an ink cartridge casing including an container that accommodates ink; and a liquid sensor including a semiconductor device that detects and manages information relating to the ink accommodated in the container, wherein the semiconductor device includes:

a semiconductor substrate including an active element formation face on which an active element is formed, and a rear face that is on a side opposite to the active element formation face;

detection electrodes formed on or above the active element formation face and exposed in the container, and detecting a remaining amount of the ink by being wet therein;

a penetration electrode penetrating in a thickness direction of the semiconductor substrate from the active element formation face to the rear face; and contact electrodes formed on or above the rear face, electrically connected to the detection electrodes via the penetration electrode, exposed toward the electrical contact point of the electronic device unit, and transmitting and receiving information to or from the electrical contact point.

12. The ink cartridge according to claim 11, wherein a plurality pairs of the detection electrodes of the semiconductor device are formed along the depth direction of the container, the detection electrodes being arranged along a bottom face of the container.

13. The ink cartridge according to claim 12, wherein a plurality of the semiconductor devices are formed along the depth direction of the container, the detection electrodes of at least one of the semiconductor devices being arranged along a bottom face of the container.

14. An electronic device comprising:

an electronic device unit including an electrical contact point; and the ink cartridge according to claim 11 that is electrically connected to the electronic device unit via the electrical contact point.

* * * * *